US009118110B2

(12) United States Patent
Wong et al.

(10) Patent No.: US 9,118,110 B2
(45) Date of Patent: Aug. 25, 2015

(54) COMMUNICATION DEVICE AND ANTENNA ELEMENT THEREIN

(75) Inventors: Kin-Lu Wong, Kaohsiung (TW); Wun-Jian Lin, Kaohsiung (TW)

(73) Assignee: ACER INCORPORATED, Taipei Hsien (TW)

( * ) Notice: Subject to any disclaimer, the term of this patent is extended or adjusted under 35 U.S.C. 154(b) by 249 days.

(21) Appl. No.: 13/599,092

(22) Filed: Aug. 30, 2012

(65) Prior Publication Data

US 2013/0342417 A1 Dec. 26, 2013

(30) Foreign Application Priority Data

Jun. 22, 2012 (TW) ..... 101122356 A

(51) Int. Cl.
*H01Q 1/38* (2006.01)
*H01Q 1/24* (2006.01)
*H01Q 1/48* (2006.01)

(52) U.S. Cl.
CPC . *H01Q 1/243* (2013.01); *H01Q 1/48* (2013.01)

(58) Field of Classification Search
USPC ..... 343/700 MS, 702, 848
See application file for complete search history.

(56) References Cited

U.S. PATENT DOCUMENTS 6,314,273 B1 11/2001 Matsuda
7,450,072 B2 * 11/2008 Kim et al. ..... 343/700 MS
7,629,930 B2 * 12/2009 Murch et al. ..... 343/700 MS
7,768,466 B2 * 8/2010 Chi et al. ..... 343/741
7,872,605 B2 * 1/2011 Baliarda et al. ..... 343/700 MS
8,233,950 B2 7/2012 Hobson et al.
2008/0167073 A1 7/2008 Hobson et al.
2008/0316118 A1 * 12/2008 Puente Baliarda et al. ... 343/702
2010/0019038 A1 * 1/2010 Puente Baliarda et al. ... 235/439

FOREIGN PATENT DOCUMENTS

CN 102195122 9/2011
EP 2 355 242 8/2011
TW 200843199 11/2008
WO WO 03/009417 1/2003
WO WO 2012/024578 2/2012

OTHER PUBLICATIONS

European Search Report dated Nov. 4, 2013.
Chinese language office action dated Jan. 21, 2015, issued in Chinese Application Ser. No. 201210218259.4, 2012.
Taiwanese language office action dated Mar. 19, 2015, issued in Taiwan Application Ser. No. 101122356, 2015.

* cited by examiner

*Primary Examiner* — Hoang V Nguyen
*Assistant Examiner* — Hai Tran
(74) *Attorney, Agent, or Firm* — McClure, Qualey & Rodack, LLP

(57) ABSTRACT

A communication device including an antenna element, a ground element and a battery element is provided. The ground element has a short edge as a first edge and a long edge as a second edge. The antenna element is close to the first edge or at a dented section of the first edge. There is a notch in the ground element, and an open edge of the notch is at the second edge. The length of the notch is at least 0.3 times the maximum length of the ground element, and the width of the notch is at least 0.4 times the maximum width of the ground element.

11 Claims, 6 Drawing Sheets

COMMUNICATION DEVICE AND ANTENNA ELEMENT THEREIN

CROSS REFERENCE TO RELATED APPLICATIONS

This Application claims priority of Taiwan Patent Application No. 101122356 filed on Jun. 22, 2012, the entirety of which is incorporated by reference herein.

BACKGROUND OF THE INVENTION

1. Field of the Invention

The disclosure generally relates to a communication device, and more particularly, relates to a communication device with a ground element to increase the bandwidth of an antenna element.

2. Description of the Related Art

Nowadays, the most popular mobile communication devices are smart phones, which have a variety of functions to satisfy demands of users. Consumers usually select different brands and types of smart phones by considering the weight and thickness thereof. To decrease the thickness, a traditional method is to integrate a system circuit board with a battery element, wherein the system circuit board and the battery element are both disposed on a same plane. Accordingly, the system circuit board does not have a whole rectangular shape. It is a critical challenge for an antenna designer to make a wideband antenna by using a non-rectangular ground element.

To sum up, there is a need to design a novel communication device and a ground element therein, wherein the ground element not only effectively decreases the thickness of the communication device but also increases the bandwidth of an antenna element.

BRIEF SUMMARY OF THE INVENTION

The invention is aimed at providing a slim communication device and a ground element therein for increasing the bandwidth of an antenna element. The communication device comprises a shaped ground element structure, which has a specific size to increase excited surface currents on the ground element and to increase the bandwidth of the antenna element.

In an embodiment, the disclosure is directed to a communication device, comprising: an antenna element; a ground element, having a first edge and a second edge, wherein the first edge is a short edge of the ground element, the second edge is a long edge of the ground element, the antenna element is close to the first edge, the ground element further has a notch, an open edge of the notch is located at the second edge, a length of the notch is at least 0.3 times the maximum length of the ground element, and a width of the notch is at least 0.4 times the maximum width of the ground element; and a battery element, located in the notch of the ground element, and coupled to the ground element.

The notch of the ground element increases surface currents flowing in a direction parallel to the second edge on the ground element such that the bandwidth of the antenna element is increased. The battery element is disposed in the notch of the ground element. The battery element further comprises a conductive portion which is electrically coupled to a specific position of the ground element such that the battery element has little impact on the surface currents on the ground element.

In some embodiments, the ground element has an L-shape, a C-shape, or an F-shape. The length of the notch is at least 0.3 times the maximum length of the ground element, and the width of the notch is at least 0.4 times the maximum width of the ground element. In the embodiment, when the antenna element operates at a specific frequency, the surface currents flowing in the direction parallel to the second edge on the ground element are guided to be concentrated and enhanced. Accordingly, the whole communication device may be seen as a well-excited antenna structure, in which the shaped ground element is effectively excited to be a good radiator, thereby increasing the operation bandwidth of the antenna element at a specific frequency.

In some embodiments, the notch of the ground element substantially has a rectangular shape, and the notch is configured to accommodate a battery element. By disposing the battery element and the ground element on a same plane, the invention can effectively decrease the thickness of the whole system, so that it may be suitably used in a slim communication device. The size of the notch of the ground element is adjustable according to the size of the battery element, and the size of the notch is within a flexible range in design. Generally, there is a metal structure located in the battery element. If the battery element is not electrically coupled to the ground element, the surface currents flowing in the direction parallel to the second edge on the ground element will be affected seriously, thereby decreasing the operation bandwidth of the antenna element. Accordingly, the shaped ground element should be electrically coupled to the battery element at a specific position such that the battery element has little impact on the surface currents on the ground element.

In some embodiments, the antenna element is substantially not covered by the ground element to maintain good radiation performance One wavelength of the lowest operation frequency of the antenna element is at least 2.5 times the maximum length of the ground element. The shaped ground element mainly improves the bandwidth of low bands in communication bands (e.g., GSM850/900 bands, or LTE700/GSM850/900 bands). In this situation, the communication device may be seen as a dipole antenna, wherein one end of the dipole antenna is the antenna element, and the other end of the dipole antenna is the ground element. The invention proposes a design of the shaped ground element to be appropriately integrated with the battery element such that the thickness of the communication device is decreased, and the operation bandwidth of the antenna element is increased effectively.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures thereof in the invention are shown in detail as follows.

Figure 1:
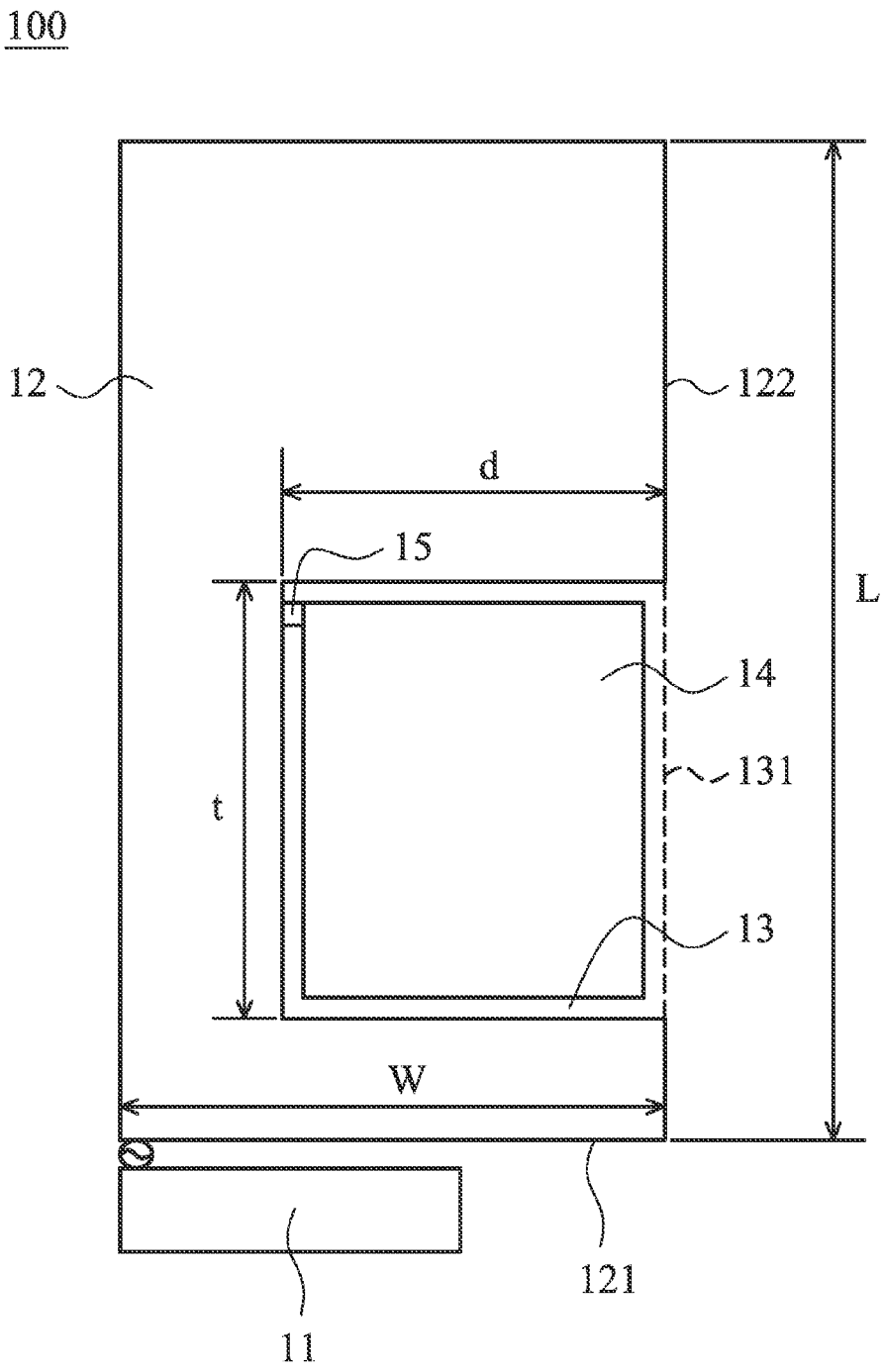
FIG. 1 is a diagram for illustrating a communication device according to a first embodiment of the invention.

FIG. 1 is a diagram for illustrating a communication device 100 according to a first embodiment of the invention. As shown in FIG. 1, the communication device 100 comprises an antenna element 11, a ground element 12, and a battery element 14. The ground element 12 has a first edge 121 and a second edge 122, wherein the first edge 121 is a short edge of the ground element 12, and the second edge 122 is a long edge of the ground element 12. The antenna element 11 is close to the first edge 121. In other embodiments, the first edge 121 has a dented section, and the antenna element 11 is substantially located in the dented section. The ground element 12 further has a notch 13, wherein an open edge 131 of the notch 13 is located at the second edge 122. The length t of the notch 13 is at least 0.3 times the maximum length L of the ground element 12, and the width d of the notch 13 is at least 0.4 times the maximum width W of the ground element 12. The notch 13 increases the surface currents flowing in the direction parallel to the second edge 122 on the ground element 12 such that the bandwidth of the antenna element 11 is increased. The battery element 14 is located in the notch 13. The battery element 14 further comprises a conductive portion 15 coupled to a specific position of the ground element 12 such that the battery element 14 has little impact on the surface currents on the ground element 12. In the first embodiment, the ground element 12 substantially has a C-shape, and the notch 13 substantially has a rectangular shape. The antenna element 11 is substantially not covered by the ground element 12. One wavelength of the lowest operation frequency of the antenna element 11 is at least 2.5 times the maximum length L of the ground element 12.

Figure 2A:
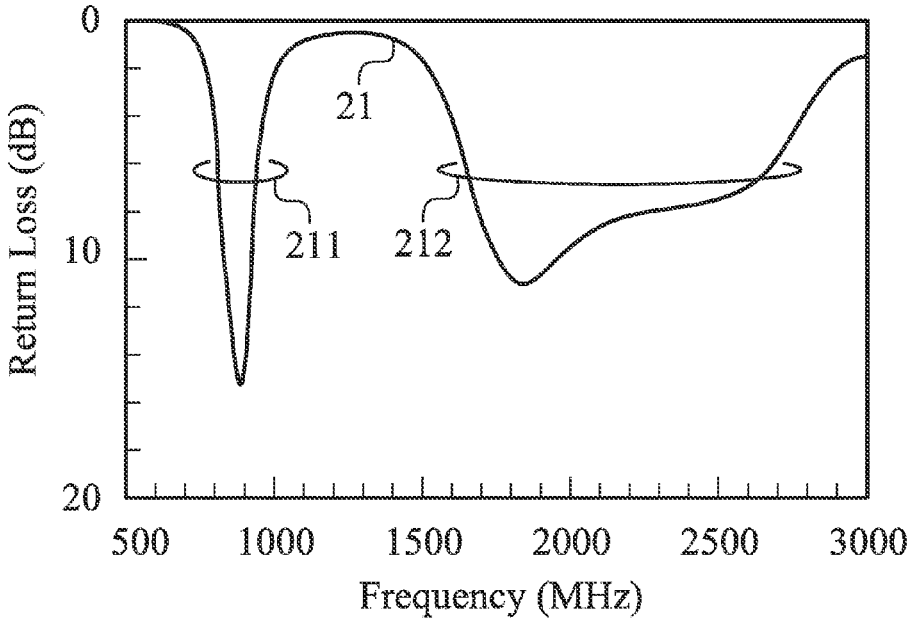
FIG. 2A is a diagram for illustrating return loss of the communication device according to the first embodiment of the invention.
Figure 2B:
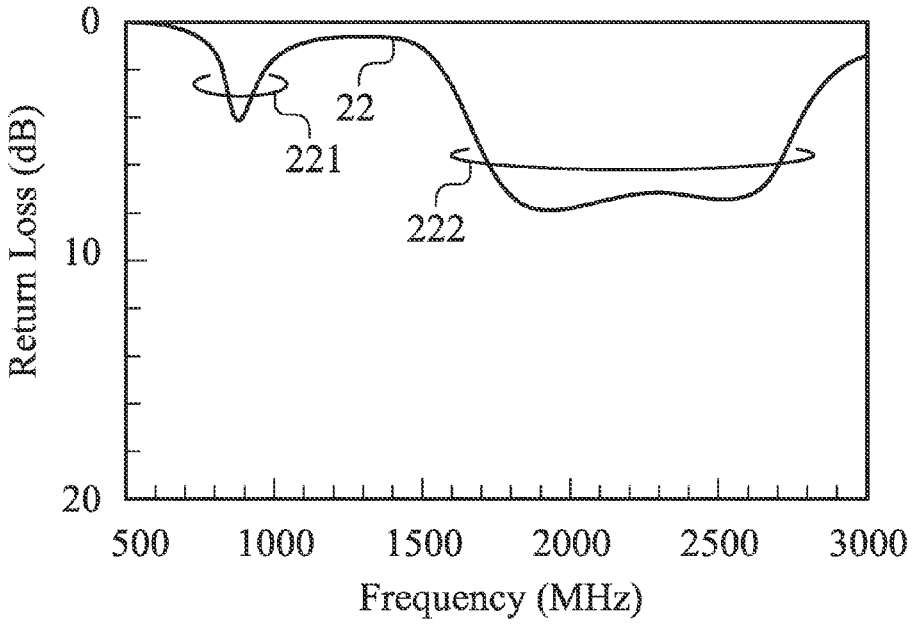
FIG. 2B is a diagram for illustrating return loss of the communication device in which a ground element has no notch according to the first embodiment of the invention.

FIG. 2A is a diagram for illustrating return loss of the communication device 100 according to the first embodiment of the invention. In some embodiments, the maximum length L of the ground element 12 is approximately equal to 100 mm, the maximum width W of the ground element 12 is approximately equal to 60 mm, the area of the antenna element 11 is merely approximately equal to 250 $mm^2$ (25 mm by 10 mm), the length t of the notch 13 is approximately equal to 40 mm, and the width d of the notch 13 is approximately equal to 30 mm. The antenna element 11 is a simple planar structure. However, the invention is not limited to the above, and the foregoing sizes and parameters of elements may be adjusted according to different desired band. FIG. 2B is a diagram for illustrating return loss of the communication device 100 in which the ground element 12 has no notch 13 according to the first embodiment of the invention. As shown in FIG. 2A, the return loss curve 21 in the first embodiment comprises a low first band 211 and a high second band 212. As shown in FIG. 2B, if the ground element 12 has no notch 13, the return loss curve 22 will comprise a low first band 221 and a high second band 222. Compared to the first band 221 in FIG. 2B, it is observed that the notch 13 of the ground element 12 in the first embodiment increases the operation band of the first band 211 very much in FIG. 2A. In addition, the notch 13 substantially does not affect the matching impedance in the second band 212. The ground element 12 in the first embodiment is designed to reduce the size of the antenna element 11. In the first embodiment, the first band 211 of the antenna element 11 may cover GSM850/900 bands (about from 700 MHz to 960 MHz), and the second band 212 of the antenna element 11 may cover GSM1800/1900/UMTS/LTE2300/2500 bands (about from 1710 MHz to 2690 MHz), being applicable for current mobile communication devices.

Figure 3:
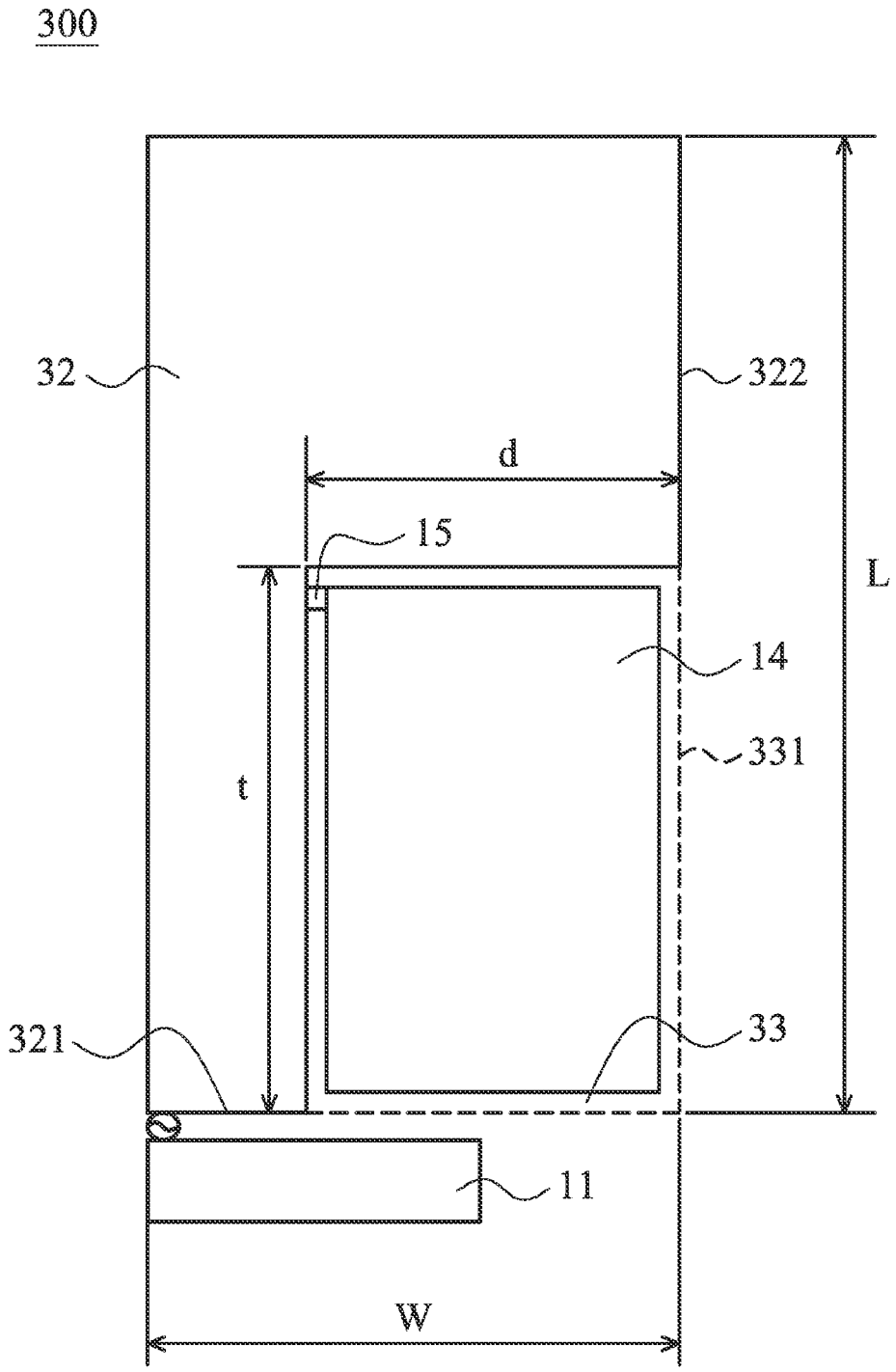
FIG. 3 is a diagram for illustrating a communication device according to a second embodiment of the invention.

FIG. 3 is a diagram for illustrating a communication device 300 according to a second embodiment of the invention. In the second embodiment, a ground element 32 substantially has an L-shape, and the ground element 32 has a notch 33. The notch 33 is a corner notch. The antenna element 11 is close to a first edge 321 of the ground element 32. The location and size (the length t and the width d) of the notch 33 are selected to be consistent with the different system circuit board layouts and the different battery element 14 sizes. Other features in the second embodiment are similar to those in the first embodiment. Accordingly, the performance of the communication device 300 in the second embodiment is almost the same as that of the communication device 100 in the first embodiment.

Figure 4:
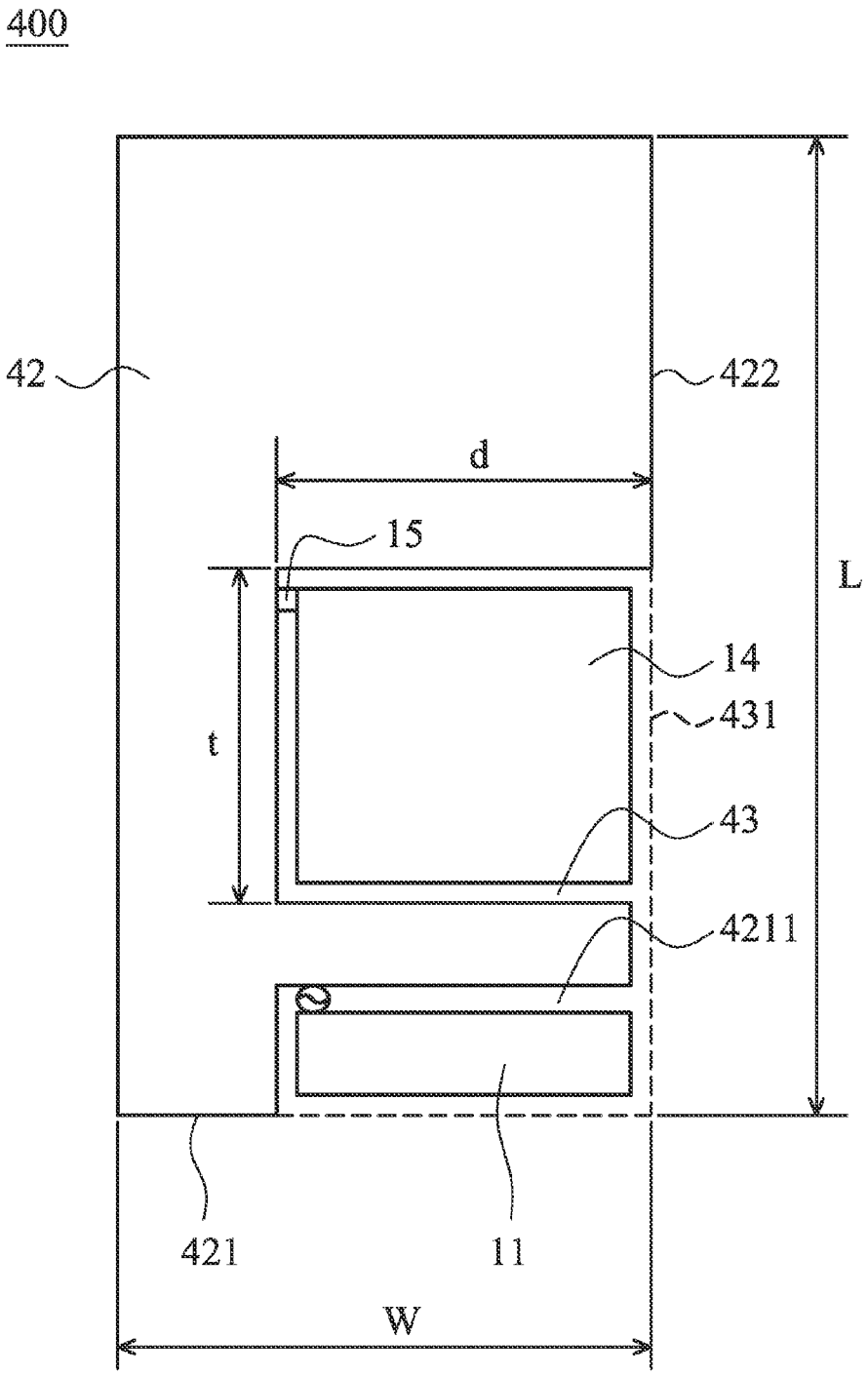
FIG. 4 is a diagram for illustrating a communication device according to a third embodiment of the invention.

FIG. 4 is a diagram for illustrating a communication device 400 according to a third embodiment of the invention. In the third embodiment, a ground element 42 substantially has an F-shape, and the ground element 42 has a notch 43. An open edge 431 of the notch 43 is located at a second edge 422 of the ground element 42. A first edge 421 of the ground element 42 has a dented section 4211, which is substantially located at a corner of the ground element 42. The antenna element 11 is substantially located in the dented section 4211 of the first edge 421. The location and size (the length t and the width d) of the notch 43 are selected to be consistent with the different system circuit board layouts and the different battery element 14 sizes. Other features in the third embodiment are similar to those in the first embodiment. Accordingly, the performance of the communication device 400 in the third embodiment is almost the same as that of the communication device 100 in the first embodiment.

Figure 5:
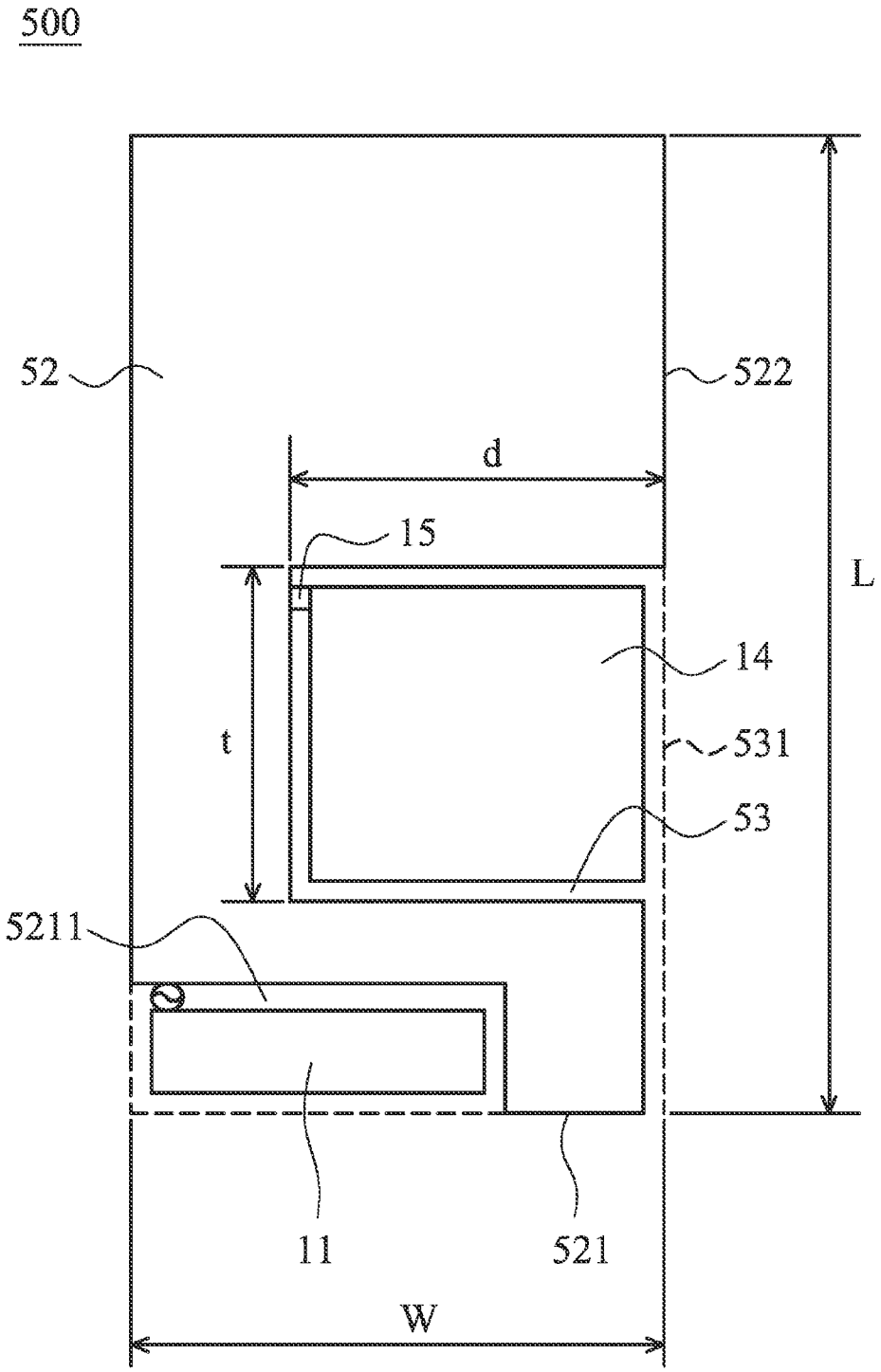
FIG. 5 is a diagram for illustrating a communication device according to a fourth embodiment of the invention.

FIG. 5 is a diagram for illustrating a communication device 500 according to a fourth embodiment of the invention. In the fourth embodiment, a ground element 52 substantially has a C-shape, and the ground element 52 has a notch 53. An open edge 531 of the notch 53 is located at a second edge 522 of the ground element 52. A first edge 521 of the ground element 52 has a dented section 5211, which is substantially located at another corner of the ground element 52. The antenna element 11 is substantially located in the dented section 5211 of the first edge 521. The location and size (the length t and the width d) of the notch 53 are selected to be consistent with the different system circuit board layouts and the different battery element 14 sizes. Other features in the fourth embodiment are similar to those in the first embodiment. Accordingly, the performance of the communication device 500 in the fourth embodiment is almost the same as that of the communication device 100 in the first embodiment.

Figure 6:
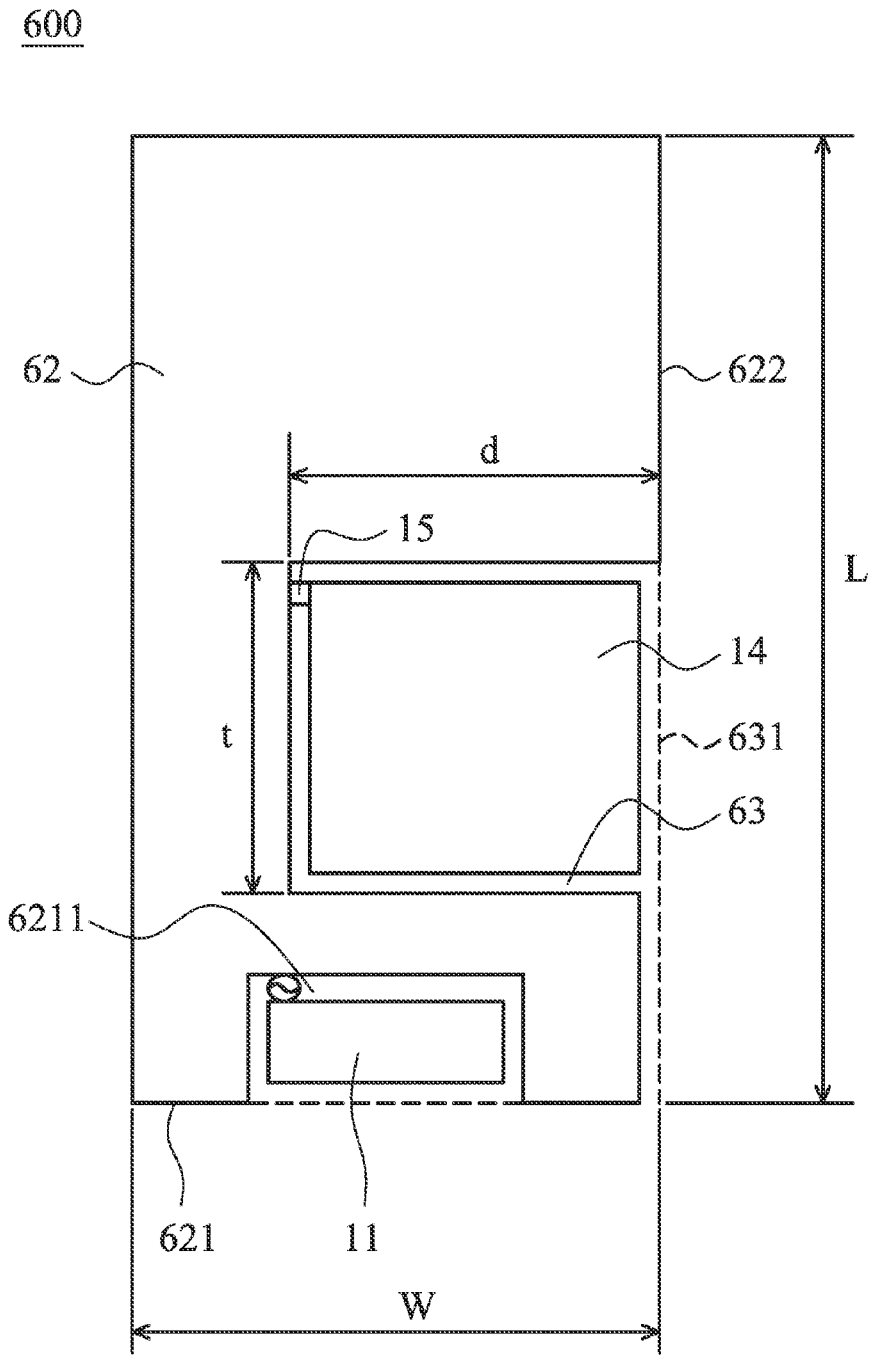
FIG. 6 is a diagram for illustrating a communication device according to a fifth embodiment of the invention.

FIG. 6 is a diagram for illustrating a communication device 600 according to a fifth embodiment of the invention. In the fifth embodiment, a ground element 62 has a notch 63. An open edge 631 of the notch 63 is located at a second edge 622 of the ground element 62. A first edge 621 of the ground element 62 has a dented section 6211, which is substantially located at the middle of the first edge 621. The antenna element 11 is substantially located in the dented section 6211 of the first edge 621. The location and size (the length t and the width d) of the notch 63 are selected to be consistent with the different system circuit board layouts and the different battery element 14 sizes. Other features in the fifth embodiment are similar to those in the first embodiment. Accordingly, the performance of the communication device 600 in the fifth embodiment is almost the same as that of the communication device 100 in the first embodiment.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A communication device, comprising:

an antenna element;

a ground element, having a first edge and a second edge, wherein the first edge is a short edge of the ground element, the second edge is a long edge of the ground element, the antenna element is close to the first edge, the ground element further has a notch, an open edge of the notch is located at the second edge, a length of the notch is at least 0.3 times the maximum length of the ground element, and a width of the notch is at least 0.4 times the maximum width of the ground element; and a battery element, located in the notch of the ground element, and coupled to the ground element.

2. The communication device as claimed in claim 1, wherein the notch of the ground element increases surface currents flowing in a direction parallel to the second edge on the ground element such that bandwidth of the antenna element is increased.

3. The communication device as claimed in claim 1, wherein the notch substantially has a rectangular shape.

4. The communication device as claimed in claim 1, wherein the battery element further comprises a conductive portion coupled to a specific position of the ground element such that the battery element has little impact on surface currents on the ground element.

5. The communication device as claimed in claim 1, wherein the first edge of the ground element has a dented section, and the antenna element is located in the dented section.

6. The communication device as claimed in claim 5, wherein the dented section is substantially located at a corner of the ground element.

7. The communication device as claimed in claim 1, wherein the ground element substantially has an L-shape.

8. The communication device as claimed in claim 1, wherein the ground element substantially has a C-shape.

9. The communication device as claimed in claim 1, wherein the ground element substantially has an F-shape.

10. The communication device as claimed in claim 1, wherein one wavelength of the lowest operation frequency of the antenna element is at least 2.5 times the maximum length of the ground element.

11. The communication device as claimed in claim 1, wherein the antenna element is excited to form at least a first band and a second band, the first band is approximately from 700 MHz to 960 MHz, and the second band is approximately from 1710 MHz to 2690 MHz.

* * * * *